US012669132B2

(12) United States Patent
Wang

(10) Patent No.: US 12,669,132 B2
(45) Date of Patent: Jun. 30, 2026

(54) ROTARY INFLATING AND DEFLATING PUMP

(71) Applicant: Boluo Futian Fumao plastic hardware products Co., Ltd., Huizhou (CN)

(72) Inventor: Qihao Wang, Huizhou (CN)

(73) Assignee: Boluo Futian Fumao plastic hardware products Co., Ltd., Huizhou (CN)

( * ) Notice: Subject to any disclaimer, the term of this patent is extended or adjusted under 35 U.S.C. 154(b) by 0 days.

(21) Appl. No.: 18/969,396

(22) Filed: Dec. 5, 2024

(65) Prior Publication Data

US 2026/0063140 A1 Mar. 5, 2026

(30) Foreign Application Priority Data

Aug. 28, 2024 (CN) ..... 202422109156.5

(51) Int. Cl.

| | |
|---|---|
| ***F04D 29/42*** | (2006.01) |
| ***F04D 17/16*** | (2006.01) |
| ***F04D 25/06*** | (2006.01) |
| ***F04D 25/08*** | (2006.01) |
| ***F04D 27/00*** | (2006.01) |
| ***F04D 29/44*** | (2006.01) |
| ***F04D 29/50*** | (2006.01) |
| ***F04D 29/62*** | (2006.01) |

(52) U.S. Cl.

CPC ..... *F04D 29/4206* (2013.01); *F04D 17/16* (2013.01); *F04D 25/06* (2013.01); *F04D 25/084* (2013.01); *F04D 27/007* (2013.01); *F04D 29/4213* (2013.01); *F04D 29/422* (2013.01); *F04D 29/441* (2013.01); *F04D 29/503* (2013.01); *F04D 29/624* (2013.01)

(58) Field of Classification Search

CPC ..... F04D 29/42–506; F04D 25/084; F04D 25/086

See application file for complete search history.

(56) References Cited

U.S. PATENT DOCUMENTS

| | | | | |
|---|---|---|---|---|
| 6,422,832 | B1 | 7/2002 | Wang | |
| 7,210,902 | B2 | 5/2007 | Song et al. | |
| 12,148,581 | B1 * | 11/2024 | Shi | F04D 25/084 |

(Continued)

FOREIGN PATENT DOCUMENTS

| | | | | |
|---|---|---|---|---|
| CN | 110094321 | A | 8/2019 | |
| CN | 111927808 | A * | 11/2020 | F04D 27/004 |

(Continued)

*Primary Examiner* — Laert Dounis

(57) ABSTRACT

A rotary inflating and deflating pump includes a housing and a pump core, the housing is provided with a chamber therein, the inner bottom wall of the chamber is provided with a housing hole; the pump core includes a pump shell and a driving member; the pump shell is detachably installed into the pump shell; a pump chamber is provided inside the pump shell, and an inlet hole and an outlet hole are provided on one end of the pump shell near the housing hole and respectively communicated with the pump chamber; the driving member is provided inside the pump chamber and used to drive gas to enter the pump chamber from the inlet hole and then flow out from the outlet hole; by rotating the pump core clockwise or counterclockwise, the pump can be changed to inflate or deflate, which is more convenient to use.

8 Claims, 13 Drawing Sheets

(56) References Cited

U.S. PATENT DOCUMENTS

| | | | | |
|---|---|---|---|---|
| 12,523,230 | B2 * | 1/2026 | Xia | F04D 25/0673 |
| 2006/0204361 | A1 * | 9/2006 | Xie | F04D 25/082<br>415/182.1 |
| 2017/0254337 | A1 * | 9/2017 | Lau | F04D 29/422 |
| 2018/0335042 | A1 | 11/2018 | Lin et al. | |
| 2020/0386235 | A1 * | 12/2020 | Huang | F04D 29/503 |
| 2020/0400149 | A1 * | 12/2020 | Huang | F04D 29/601 |
| 2023/0258199 | A1 * | 8/2023 | Huang | F04D 29/4253<br>417/423.14 |
| 2024/0376876 | A1 * | 11/2024 | Jiang | F04D 25/084 |

FOREIGN PATENT DOCUMENTS

| | | | | |
|---|---|---|---|---|
| CN | 116480551 A | * | 7/2023 | F04B 35/04 |
| CN | 117028313 A | * | 11/2023 | F04D 29/403 |
| CN | 221442775 U | | 7/2024 | |

* cited by examiner

ROTARY INFLATING AND DEFLATING PUMP

TECHNICAL FIELD

The present disclosure relates to the technical field of the pump, more particularly, to a rotary inflating and deflating pump.

BACKGROUND OF THE DISCLOSURE

A pump is a device to inflate air into an enclosed chamber or extract air from the enclosed chamber. The pump's principle is to drive the impeller to rotate by motor, thereby driving the air to flow.

With the development of technology, the pump has developed from a unidirectional inflating structure in the past to a bidirectional inflation and deflation structure today. For example, Chinese Patent CN221442775U discloses an integrated inflating and deflating pump, which includes an outer cylinder, a one-way valve mechanism located at the bottom of the outer cylinder, and an inflating and deflating mechanism that can be placed inside the outer cylinder in the forward or reverse direction. The outer cylinder is connected to the product to be inflated or deflated. The inflating and deflating mechanism has an air inlet. When the inflating and deflating mechanism is placed forward, with the air inlet closed to the product, the one-way valve mechanism seals the bottom of the outer cylinder and the inflating and deflating mechanism extracts air from the product. When the inflating and deflating mechanism is placed in reverse, with the air inlet close to the one-way valve mechanism; the one-way valve mechanism opens, and the outer cylinder is connected to the external atmospheric pressure. The inflating and deflating mechanism sucks air from the outside to fill the product. In this way, when the inflating and deflating mechanism is placed forward inside the outer cylinder, it can extract air from the product. When the inflating and deflating mechanism is placed reverse inside the outer cylinder, it can inflate the product.

However, the existing pump achieves forward extracting air and reverse inflation, which requires reversing the inflating and deflating mechanism, making it inconvenient to use. Therefore, in order to simplify the user's usage and make it more convenient to use, the applicant develops the rotary inflating and deflating pump.

SUMMARY OF THE DISCLOSURE

To overcome the shortcomings of the prior art, the present disclosure provides a rotary inflating and deflating pump, which can perform inflation and deflation without changing the placed direction of the rotary inflating and deflating pump, making it convenient to use.

The object of the present disclosure is achieved through the following technical solutions:

A rotary inflating and deflating pump includes a housing and a pump core.

The housing is provided with a chamber therein, the inner bottom wall of the chamber is provided with a housing hole.

The pump core includes a pump shell and a driving member. The pump shell is detachably installed into the pump shell. A pump chamber is provided inside the pump shell, and an inlet hole and an outlet hole are provided on one end of the pump shell near the housing hole and respectively communicated with the pump chamber. The driving member is provided inside the pump chamber and used to drive air to enter the pump chamber from the inlet hole and then flow out from the outlet hole.

When the pump core rotates clockwise in the housing under external force, one of the inlet hole and the outlet hole is communicated to the housing hole. When the pump core rotates counterclockwise in the pump housing under external force, the other of the inlet hole and the outlet hole is communicated to the housing hole. When one of the inlet hole and the outlet hole is communicated to the housing hole, the other of the inlet hole and the outlet hole is communicated to the pump shell.

Optionally, an avoidance groove is provided on the inner bottom wall of the chamber and aligns with the air outlet or the air inlet.

Optionally, a non-return valve is slidably provided on the side of the housing hole away from the chamber along an axial direction of the housing hole, and the outlet hole or the inlet hole in communication with the housing hole is used for pushing the non-return valve away from the housing hole.

Optionally, an air duct is provided in the pump shell, extending from one end of the pump shell to the other end thereof, and independent of the chamber.

Optionally, an outer wall of the pump shell is provided with clamping protrusions, an inner side wall of the chamber is provided with sliding grooves, and the clamping protrusions are accommodated in the sliding grooves in a sliding manner.

Optionally, the middle portion of the sliding groove is distributed in an oblique direction towards two ends of the sliding groove along a direction close to the housing hole.

Optionally, a column is provided on the inner bottom wall of the chamber, and a slot is provided on one end of the pump shell near the outlet hole. A sliding block is provided in the slot, and a spring is provided at the end of the sliding block away from the column. The spring is used to push the sliding block to abut against the column.

Optionally, both ends of the sliding groove are equipped with a fastening plane.

Optionally, the pump core further includes a supporting block, a pressing block, a side sliding block, and a side sliding spring. The supporting block is arranged in the pump shell, the pressing block is slidably along the axial direction of the pump shell and arranged on the top of the pump shell, and the side sliding block is slidably arranged on the supporting block, the side sliding block is connected to the pressing block, the side sliding spring is sheathed on the side sliding block, and the side sliding spring abuts against the side sliding block and the supporting block respectively. The clamping protrusion is arranged on the side sliding block, and when the pressing block is pressed, the pressing block pushes the side sliding block to slide so that the side sliding block compresses the side sliding spring, and the clamping protrusion retracts into the pump shell.

Optionally, the pump core further includes a circuit board and a sliding column. The circuit board is arranged in the pump shell, electrically connected to the driving member, and provided with a switch. The sliding column is arranged in the pump shell along the axial direction of the pump shell, with one end being in contact with the switch, and the other end extending out from one end of the pump shell close to the outlet hole. Two top blocks are provided on the inner bottom wall of the chamber, and when the pump core is rotated clockwise or anticlockwise by the external force, one of the two top blocks pushes against the sliding column.

Compared with the prior art, the present disclosure has the following advantages:

The rotary inflating and deflating pump includes a housing and a pump core, the housing is provided with a chamber therein, the inner bottom wall of the chamber is provided with a housing hole. The pump core includes a pump shell and a driving member. The pump shell is detachably installed into the pump shell. A pump chamber is provided inside the pump shell, and an inlet hole and an outlet hole are provided on one end of the pump shell near the housing hole and respectively communicated with the pump chamber. The driving member is provided inside the pump chamber and used to drive air to enter the pump chamber from the inlet hole and then flow out from the outlet hole. When the pump core rotates clockwise in the housing under external force, one of the inlet hole and the outlet hole is communicated to the housing hole. When the pump core rotates counterclockwise in the pump housing under external force, the other of the inlet hole and the outlet hole is communicated to the housing hole. When one of the inlet hole and the outlet hole is communicated to the housing hole, the other of the inlet hole and the outlet hole is communicated to the pump shell. In this way, by rotating the pump core clockwise or counterclockwise, the pump can be changed to inflate or deflate. Compared with the existing pump that needs to take out the pump core to change the direction of the pump core so as to change to inflate or deflate, the pump disclosed in the present disclosure is more convenient to use.

BRIEF DESCRIPTION OF THE DRAWINGS

To describe the technical solutions in the embodiments of the present disclosure more clearly, the following briefly introduces the accompanying drawings required for describing the embodiments. It should be understood that the following drawings only illustrate some embodiments of the present disclosure, and therefore should not be considered as limiting the scope. For a person of ordinary skill in the art, other related drawings may also be obtained according to these drawings without creative efforts.

Figure 1:
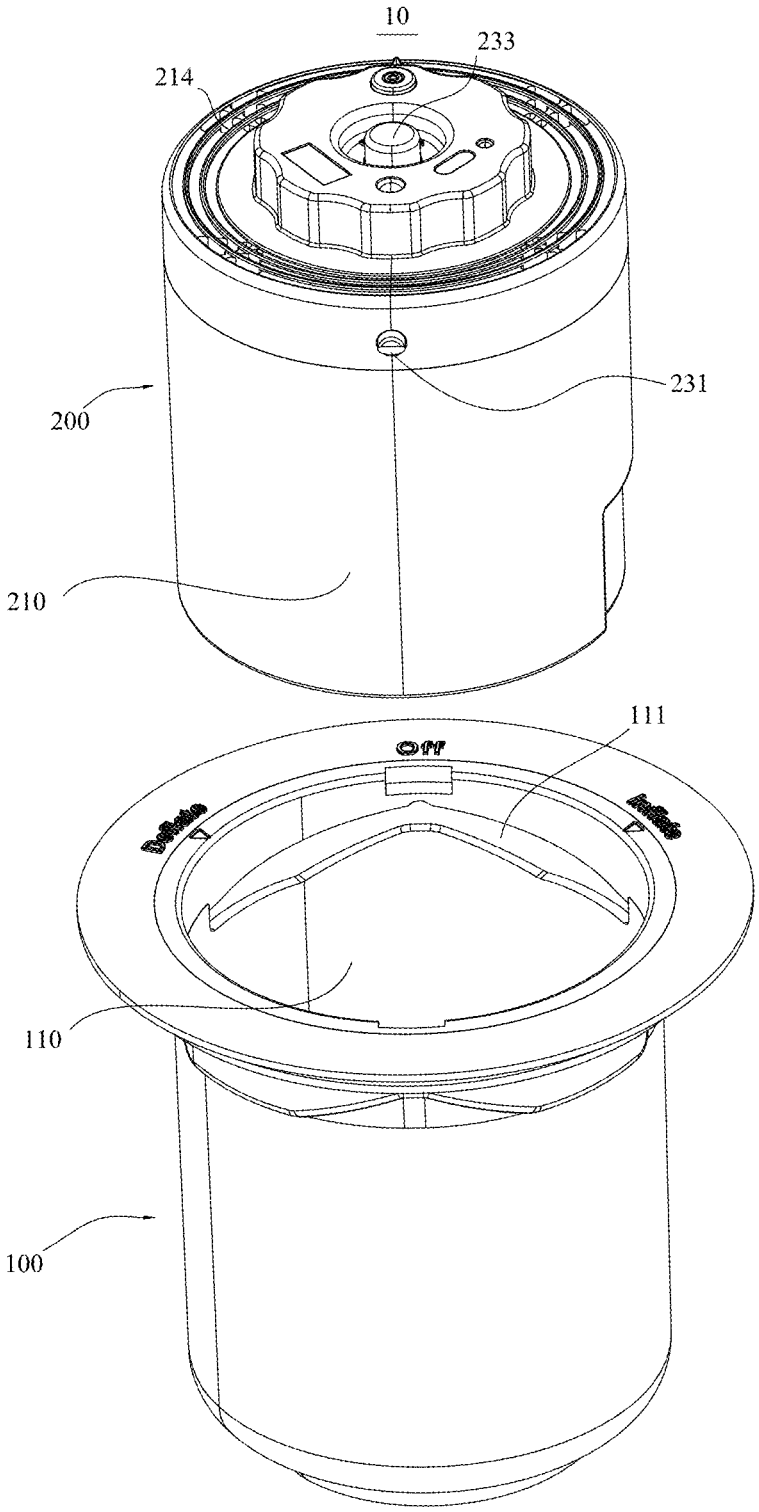
FIG. 1 is an exploded view of the rotary inflating and deflating pump according to one embodiment in the present disclosure.

| | |
|---|---|
| 10. the rotary inflating and deflating pump; | 100. the housing; |
| 200. the pump core; | 110. the chamber; |
| 120. the housing hole; | 210. the pump shell; |
| 221. the driving member; | 211. the pump chamber; |
| 212. the inlet hole; | 213. the outlet hole; |
| 130. the avoidance groove; | 300. the non-return valve; |
| 214. the air duct; | 231. the clamping protrusion; |
| 111. the sliding groove; | 410. the column; |
| 215. the slot; | 420. the sliding block; |
| 430. the spring; | 232. the supporting block; |
| 233. the pressing block; | 234. the side sliding block |
| 235. the side sliding spring; | 222. the circuit board; |
| 221. the sliding column; | 224. the switch; |
| 510. the top block; | 2331. the first inclined surface; |
| 112. the fastening plane. | |

EMBODIMENTS

In order to facilitate the understanding of the present disclosure, a more comprehensive description of the present disclosure will be provided below with reference to the relevant drawings. The preferred embodiment of the present disclosure is shown in the accompanying drawings.

As shown in FIGS. 1-9, a rotary inflating and deflating pump 10 includes a housing 100 and a pump core 200. The housing 100 is provided with a chamber 110 therein, the inner bottom wall of the chamber 110 is provided with a housing hole 120. The pump core 200 includes a pump shell 210 and a driving member 221. The pump shell 210 is detachably installed into the chamber 110. A pump chamber 211 is provided inside the pump shell 210, and an inlet hole 212 and an outlet hole 213 are provided on one end of the pump shell 210 near the housing hole 120. The inlet hole 212 and the outlet hole 213 are respectively communicated with the pump chamber 211. The driving member 221 is provided inside the pump chamber 211, which is used to drive the air to enter the pump chamber 211 from the inlet hole 212 and then flow out from the outlet hole 213. When the pump core 200 rotates clockwise in the chamber 110 under the external force, one of the inlet hole 212 and the outlet hole 213 is communicated to the housing hole 120. When the pump core 200 rotates counterclockwise in the chamber 110 under the external force, the other of the inlet hole 212 and the outlet hole 213 is communicated to the housing hole 120. When one of the inlet hole 212 and the outlet hole 213 is communicated to the housing hole 120, the other of the inlet hole 212 and the outlet hole 213 is communicated to the chamber 110.

It should be noted that the chamber 110 in the housing 100 is empty, the housing hole 120 arranged at the inner bottom wall of the chamber 110 is communicated with the chamber 110. The pump core 200 is installed into the chamber 110. The pump shell 210 is provided with the pump chamber 211, the inlet hole 212 and the outlet hole 213 are disposed at the end of the pump shell 210 close to the housing hole 120, which are respectively communicated with the pump chamber 211. The driving member 221 is mounted in the pump chamber 211. In one embodiment, the driving member 221 is a centrifugal fan. Therefore, as the driving member 221 starts, the air enters the pump chamber 211 from the inlet hole 212 and then flows out from the outlet hole 213 through the pump chamber 211. Furthermore, the pump core 200 is mounted into the chamber 110 and can rotate clockwise or counterclockwise in the chamber 110, thereby enabling the pump core 200 to cooperate with the outer shell 100 to deflate and inflate. It should be noted that the clockwise or counterclockwise direction in this disclosure refers to viewing from the inside of the chamber 110.

Specifically, the chamber 110 is in communication with the outsides, the housing hole 120 is in communication with the product to be inflated.

Example 1

When the pump core 200 rotates clockwise in the housing 110, the outlet hole 213 is in communication with the housing hole 120, the inlet hole 212 is in communication with the chamber 110. As the driving member 221 starts, the air in the chamber 110 will flow through the inlet hole 212, the pump chamber 211, the outlet hole 213, and the housing hole 120 in sequence, achieving product inflation.

When the pump core 200 rotates counterclockwise, the inlet hole 212 is in communication with the housing hole 120, the outlet hole 213 is in communication with the chamber 110. As the driving member 221 starts, the air in the product will flow through the housing hole 120, the inlet hole 212, the pump chamber 211, the outlet hole 213, and the chamber 110 in sequence, achieving product deflation.

Example 2

When the pump core 200 rotates clockwise, the inlet hole 212 is in communication with the housing hole 120, the outlet hole 213 is in communication with the chamber 110. As the driving member 221 starts, the air in the product will flow through the housing hole 120, the inlet hole 212, the pump chamber 211, the outlet hole 213, and the chamber 110 in sequence, achieving product deflation.

When the pump core 200 rotates counterclockwise, the outlet hole 213 is in communication with the housing hole 120, the inlet hole 212 is in communication with the chamber 110. As the driving member 221 starts, the air in the chamber 110 will flow through the inlet hole 212, the pump chamber 211, the outlet hole 213, and the housing hole 120 in sequence, achieving product inflation.

In this way, whether the pump inflates or deflates the product when the pump core 200 rotates clockwise, which can be designed according to specific situations.

To facilitate the explanation of the principle of the rotary inflating and deflating pump 10 in this disclosure, the following content is based on the example of inflating the product when the pump core 200 rotates clockwise.

Figure 2:
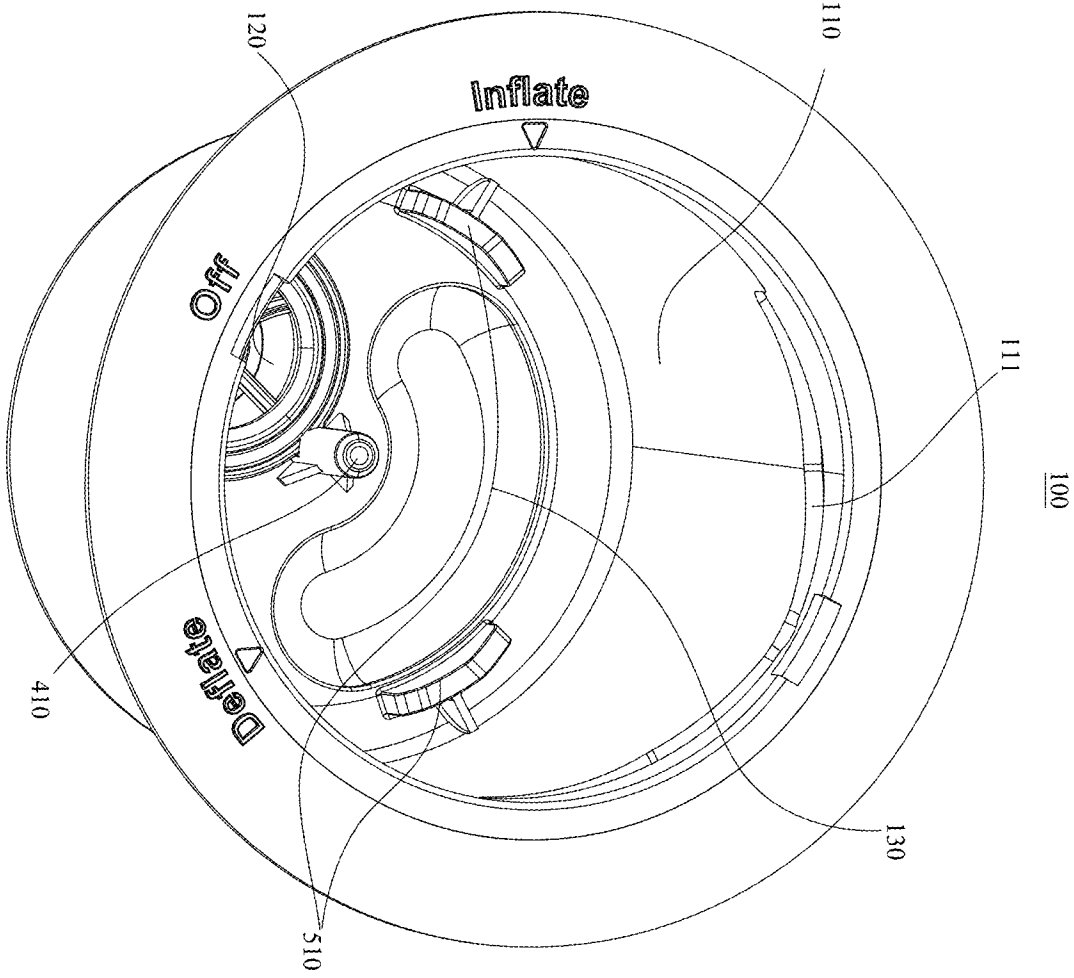
FIG. 2 is a perspective view of the housing according to one embodiment in the present disclosure.

As shown in FIG. 2, in one embodiment, an avoidance groove 130 is provided on the inner bottom wall of the chamber 110 and aligns with the outlet hole 213 or the inlet hole 212

It should be noted that both the inlet hole 212 and the outlet hole 213 protrude the end of the pump shell 210. When the inlet hole 212 is in communication with the housing hole 120, the outlet hole 213 is aligned with the avoidance groove 130. In this way, the outlet hole 212 can be in communication with the chamber 110 through the avoidance groove 130 so as to ensure the air in the product to flow through the housing hole 120, the inlet hole 212, the pump chamber 211, the outlet hole 213, the avoidance groove 130, and the chamber 110 in sequence, thereby extracting air from the product. When the outlet hole 213 is in communication with the housing hole 120, the outlet hole 212 is aligned with the avoidance groove 130. In this way, the inlet hole 212 is in communication with the chamber 110 through the avoidance groove 130 so as to ensure the air in the chamber 110 to flow through the avoidance groove 130, the inlet hole 212, the pump chamber 211, the outlet hole 213, and the housing hole 120 in sequence, then enters the product to be inflated, thereby inflating the product. In this way, by providing the avoidance groove 130, it ensures that the inlet hole 212 or the outlet hole 213 is in communication with the chamber 110.

Figure 10:
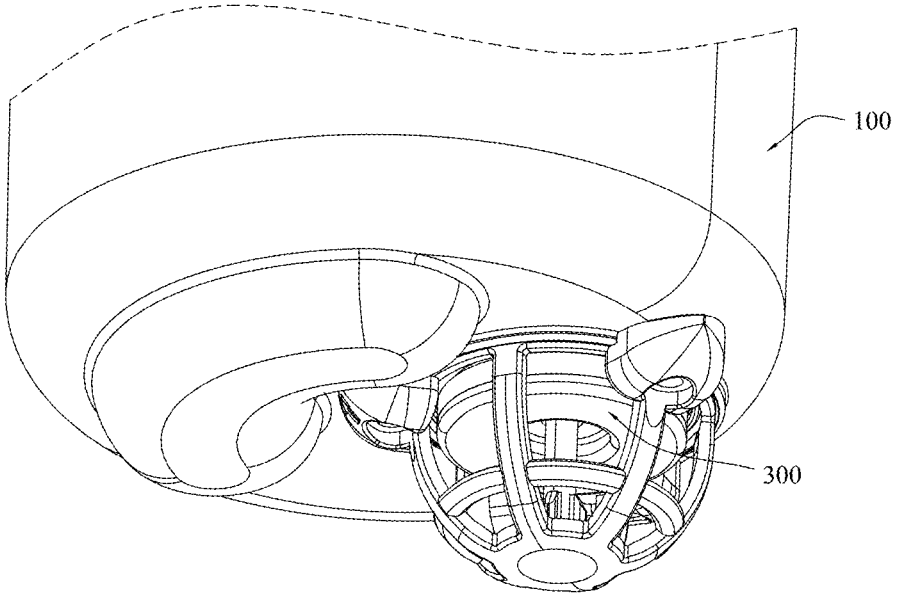
FIG. 10 is a partial view of the housing shown in FIG. 2.

As shown in FIG. 10, in one embodiment, a non-return valve 300 is provided on a side of the housing hole 120 away from the chamber 110 along an axial direction of the housing hole 120, and the outlet hole 213 or the inlet hole 212 being in communication with the housing hole 120 is used for pushing the non-return valve 300 away from the housing hole 120.

It should be noted that when the pump core 200 does not rotate clockwise or counterclockwise, both the inlet hole 212 and the outlet hole 213 are not in communication with the housing hole 120. In this occasion, the non-return valve 300 tightly fits the side of the housing hole 121 away from the chamber 110 so that the non-return valve 300 seals the housing hole 120, that is the product to be inflated is not in communication with the housing hole 120. When the inlet hole 212 is in communication with the housing hole 120, that is, the product needs to be deflated, the inlet hole 212 pushes the non-return valve 300 away from the housing hole 120 to enable the product to be in communication with the housing hole 120 so that the air in the product can flow into the inlet hole 212 from the housing hole 120, achieving to deflate from the product. When the inlet 213 is in communication with the housing hole 120, that is the product needs to be inflated, the inlet hole 213 pushes the non-return valve 300 away from the housing hole 120 so that the product is in communication with the housing hole 120, thereby the air in the outlet hole 213 flows into the product from the housing hole 120, achieving to inflate the product. In one embodiment, the non-return valve 300 is a sealing rubber sheet, pushed by a spring so as to closely fit with one side of the housing hole 120 away from the chamber 110.

Figure 3:
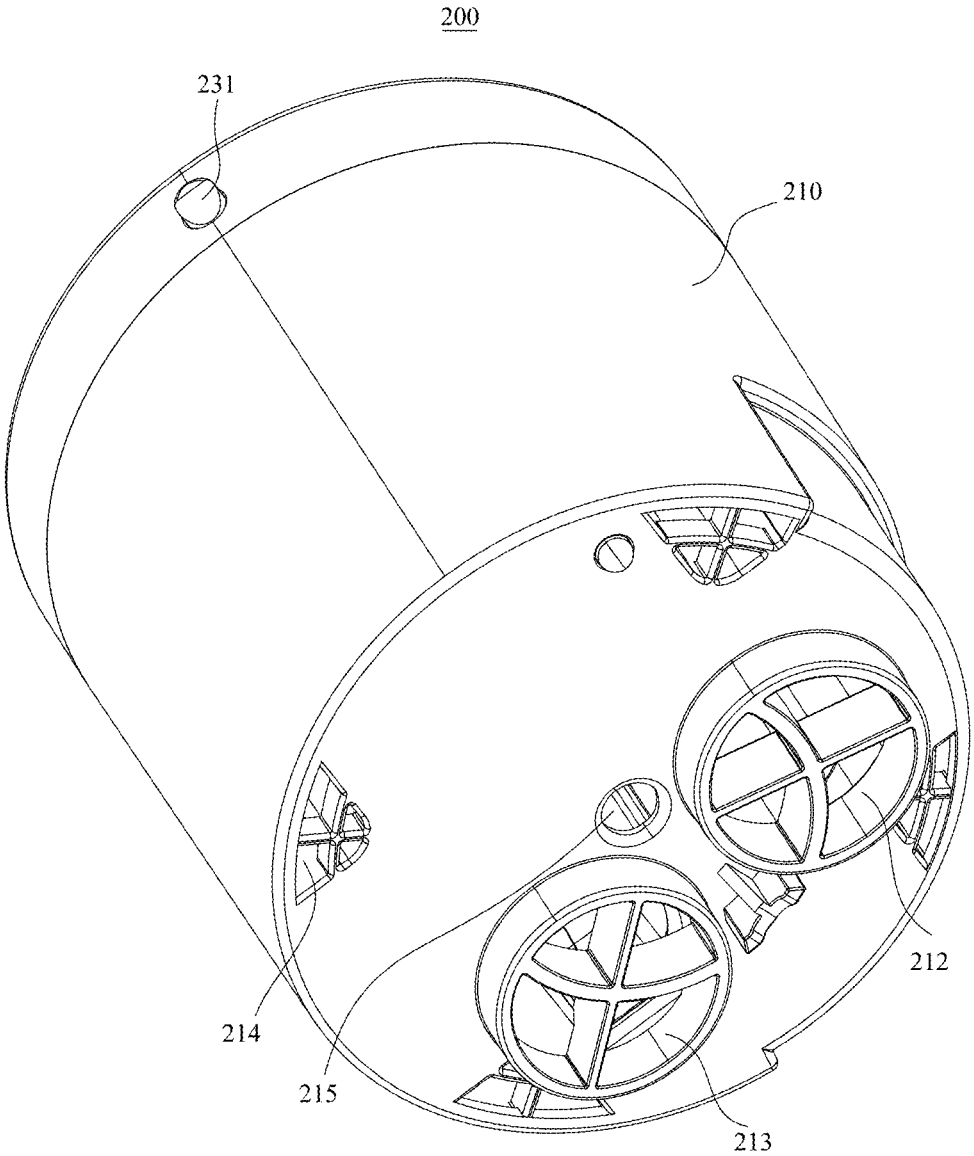
FIG. 3 is a perspective view of the pump core according to one embodiment in the present disclosure.
Figure 4:
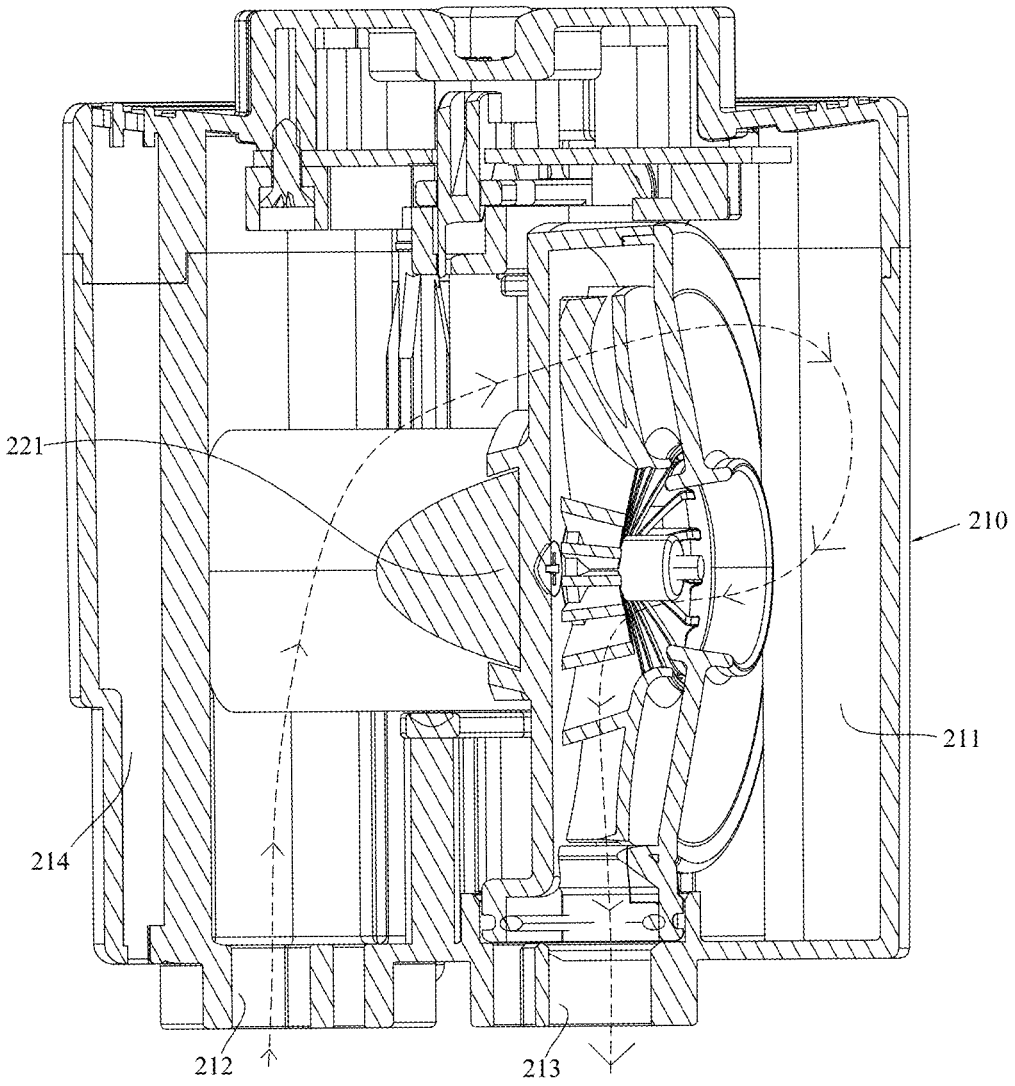
FIG. 4 is a sectional view of the pump core shown in FIG. 3.
Figure 5:
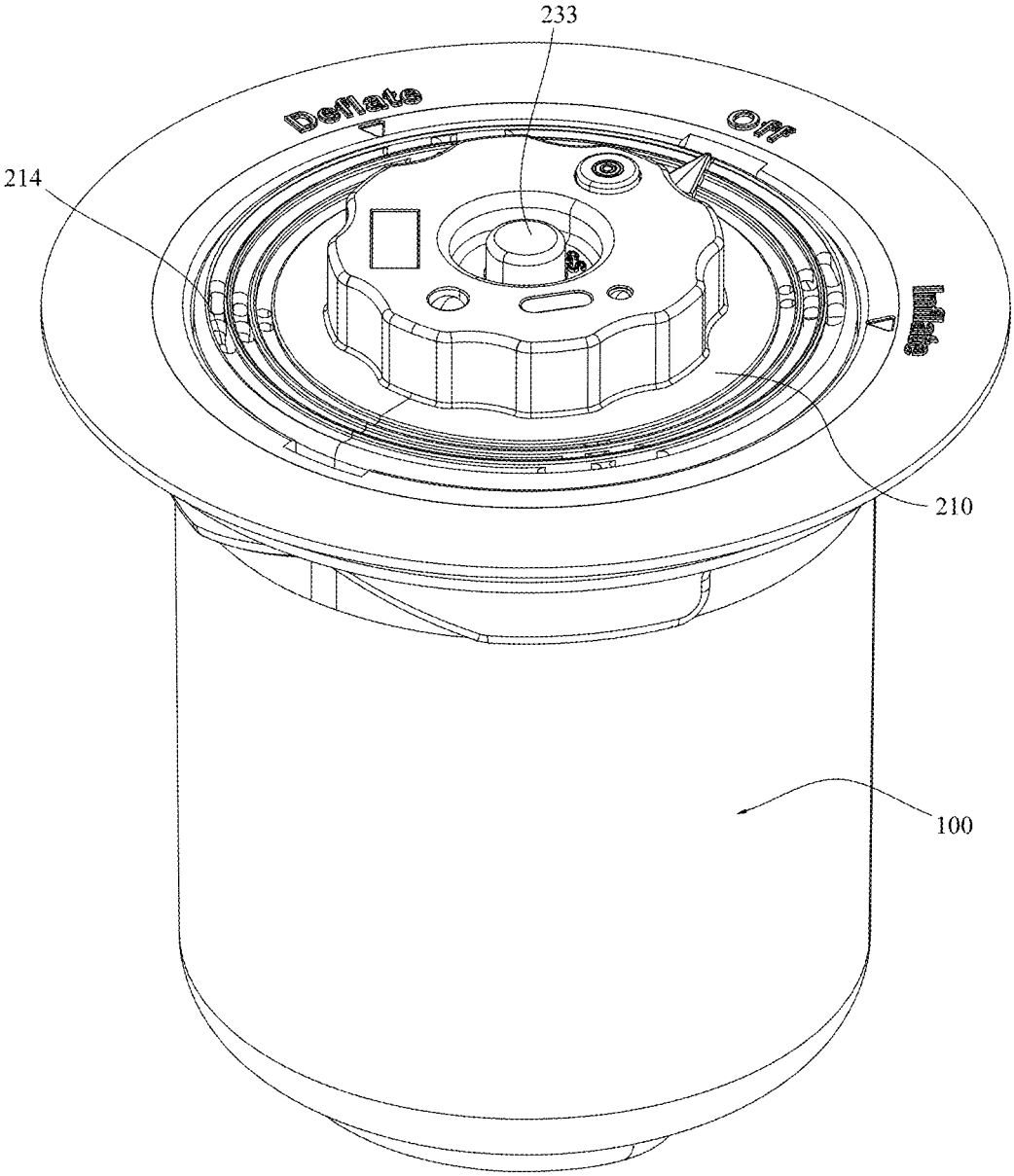
FIG. 5 is a perspective view of the rotary inflating and deflating pump shown in FIG. 1.
Figure 6:
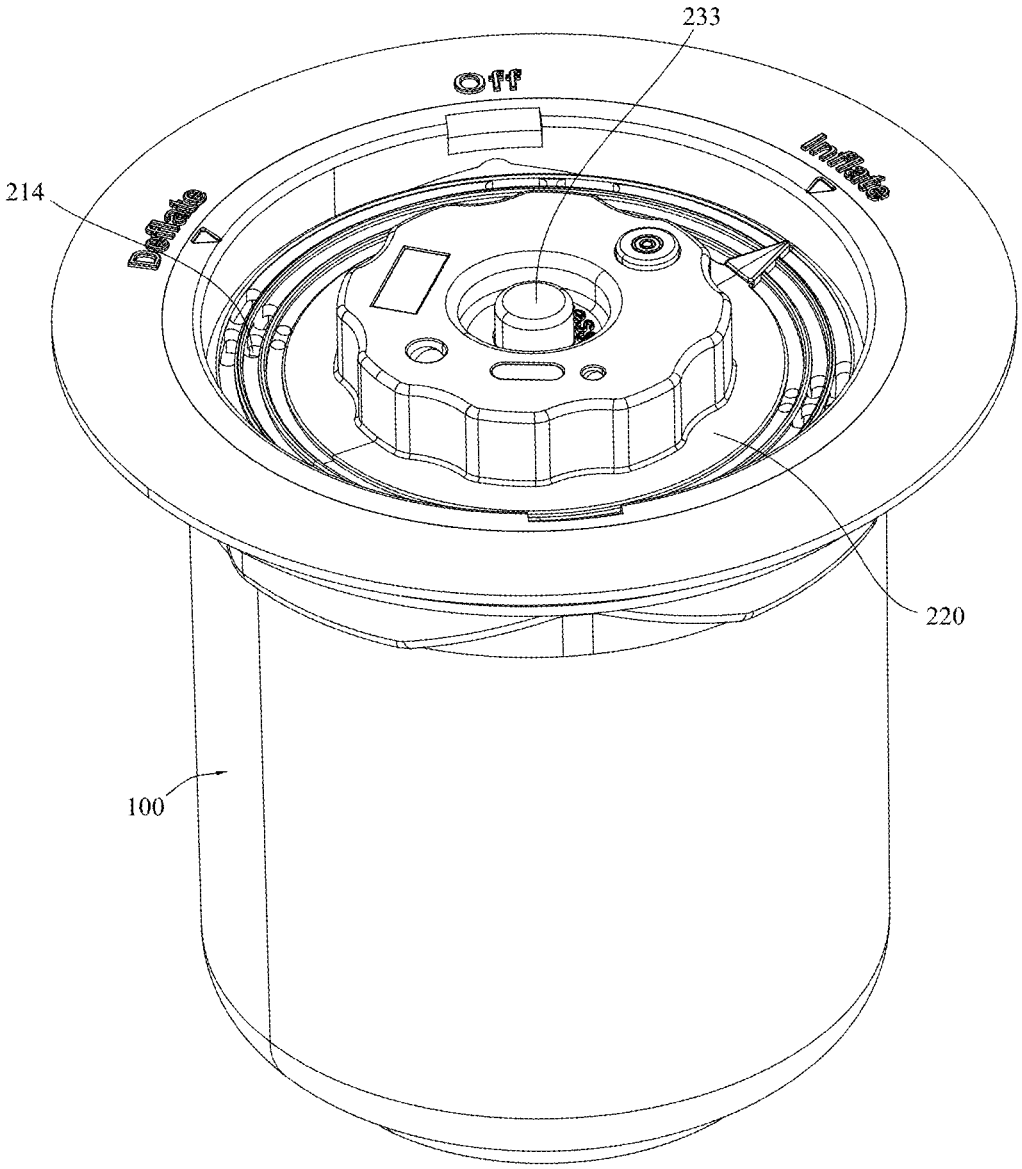
FIG. 6 is a perspective view of the rotary inflating and deflating pump shown in FIG. 1 in an inflating state.
Figure 7:
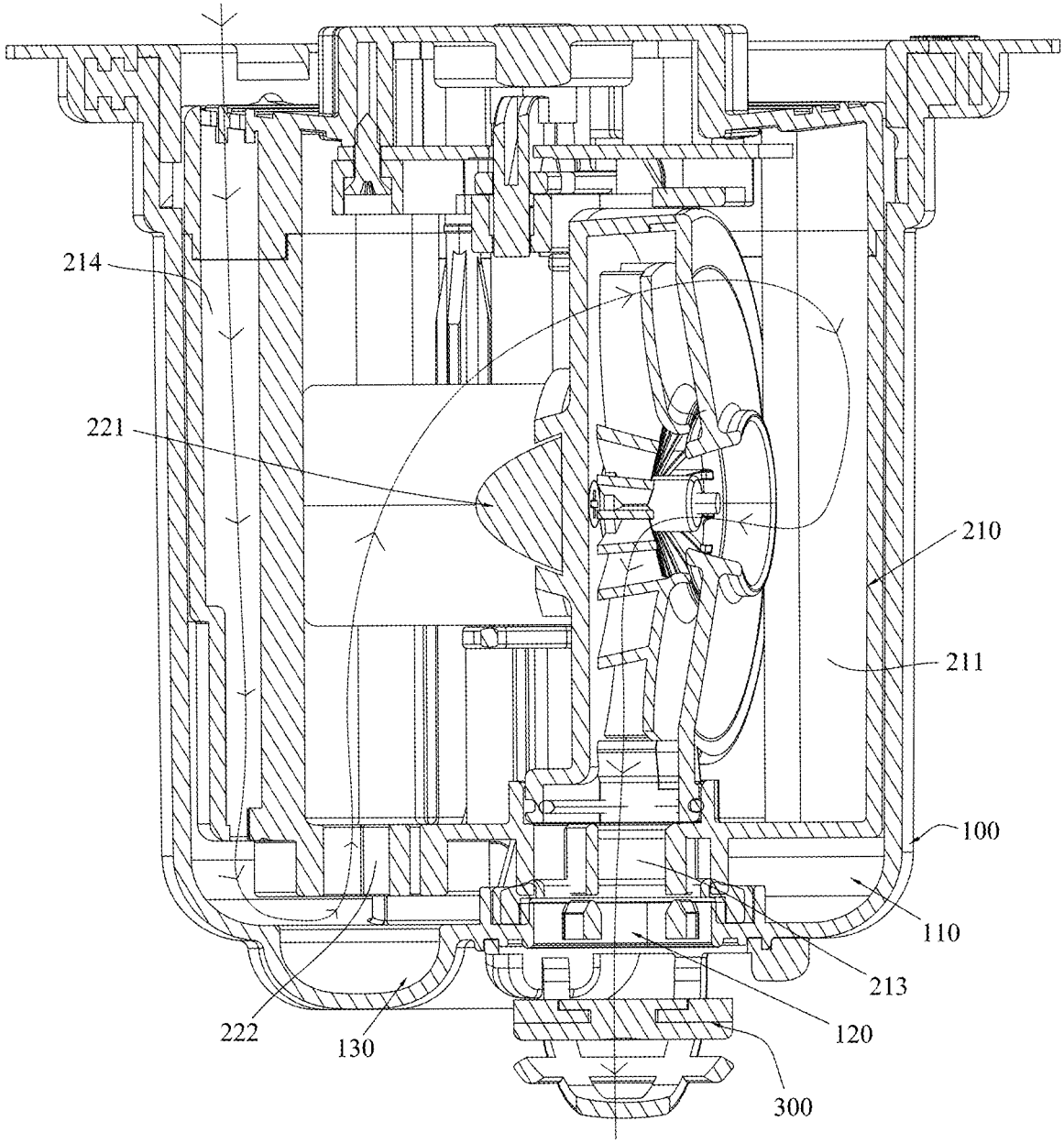
FIG. 7 is a sectional view of the rotary inflating and deflating pump shown in FIG. 6.
Figure 8:
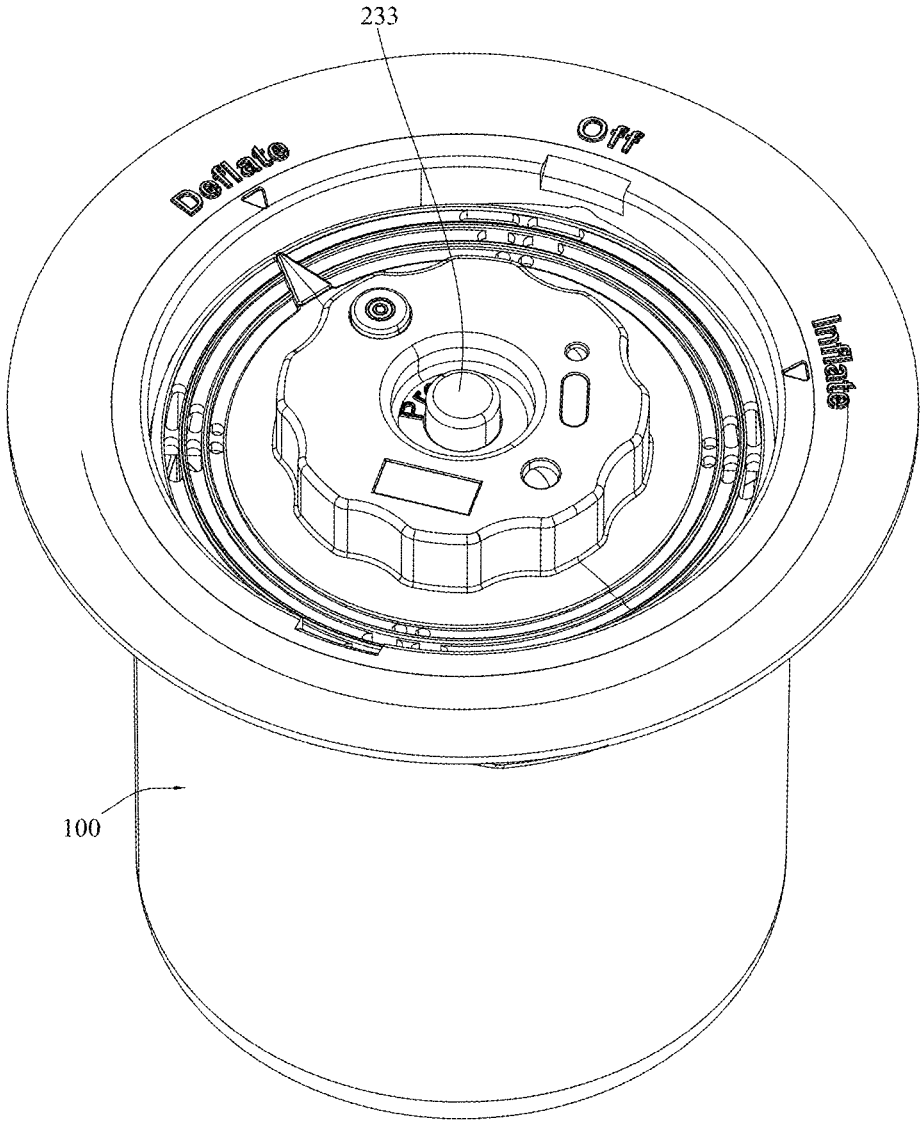
FIG. 8 is a perspective view of the rotary inflating and deflating pump shown in FIG. 1 in a deflated state.
Figure 9:
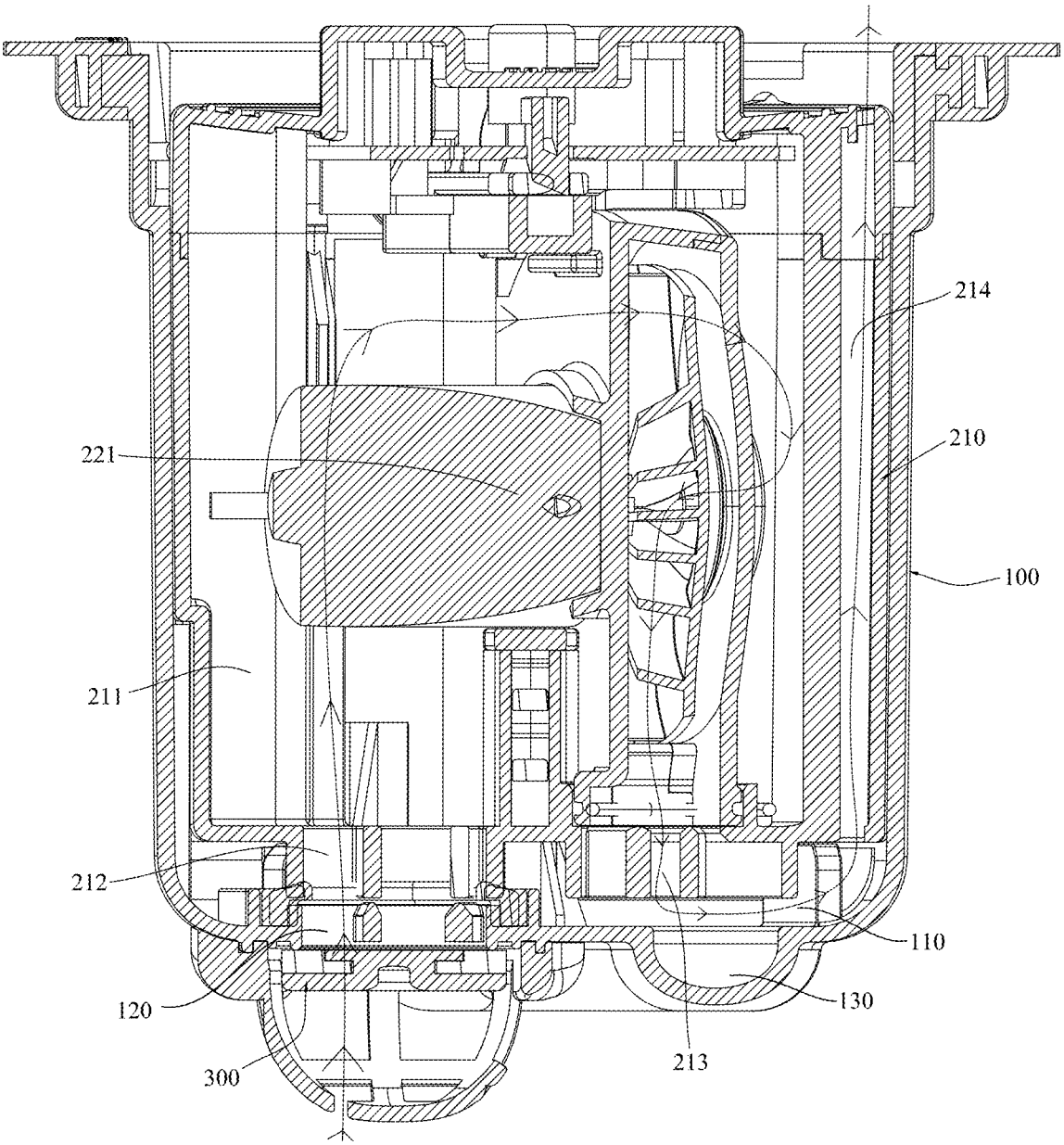
FIG. 9 is a sectional view of the rotary inflating and deflating pump shown in FIG. 8.

As shown in FIGS. 3-4, in one embodiment, an air duct 214 is provided in the pump shell 210, extending from one end of the pump shell 210 to the other end thereof, and independent of the chamber 211.

It should be noted that the pump shell 210 is in communication with the outside, therefore, the pump shell 210 is provided with a slot, for example, hereinafter, an air duct 214, to communicate with the outside. As shown in the embodiment and FIG. 9, the air duct 214 is provided on the pump shell 210, running through both ends thereof. The air duct 214 is separated from the chamber 211. In this way, when the air outlet 213 is in communication with the housing hole 120, the pump is in a state to inflate the product. With the start of the driving member 221, the external air flows into the chamber 110 from the air duct 214, then sequentially flows through the avoidance groove 130, the inlet hole 212, the chamber 211, the outlet hole 213, the housing hole 120, and finally into the product. When the inlet hole 212 is in communication with the housing hole 120, the pump is in a state to deflate the product. With the start of the driving member 221, the air in the product flows through the housing hole 120, the inlet hole 212, the chamber 211, the outlet hole 213, the avoidance groove 130, the chamber 110, and the air duct 214 in sequence, and finally flows to the outside.

In one embodiment, the pump shell 210 is provided with a plurality of air ducts 214, each penetrating through both ends of the pump shell 210, and a spacing is provided between the air ducts 214. For example, if the air duct 214 can be set as one, two, three, four, five, or the like, so that the air flow rate can be increased.

As shown in FIGS. 1-3, in one embodiment, the outer wall of the pump shell 210 is provided with clamping protrusions 231, an inner side wall of the chamber 110 is provided with sliding grooves 111, and the clamping protrusions 231 are accommodated in the sliding groove 111 in a sliding manner.

It should be noted that in order to enable the pump core 200 to stably rotate clockwise or counterclockwise in the chamber 110, the sliding grooves 111 are provided on the inner side wall of the chamber 110, and the clamping protrusion 231 are provided on the outer side wall of the pump shell 210 so that the clamping protrusions 231 slide along the sliding grooves 111.

Figure 11:
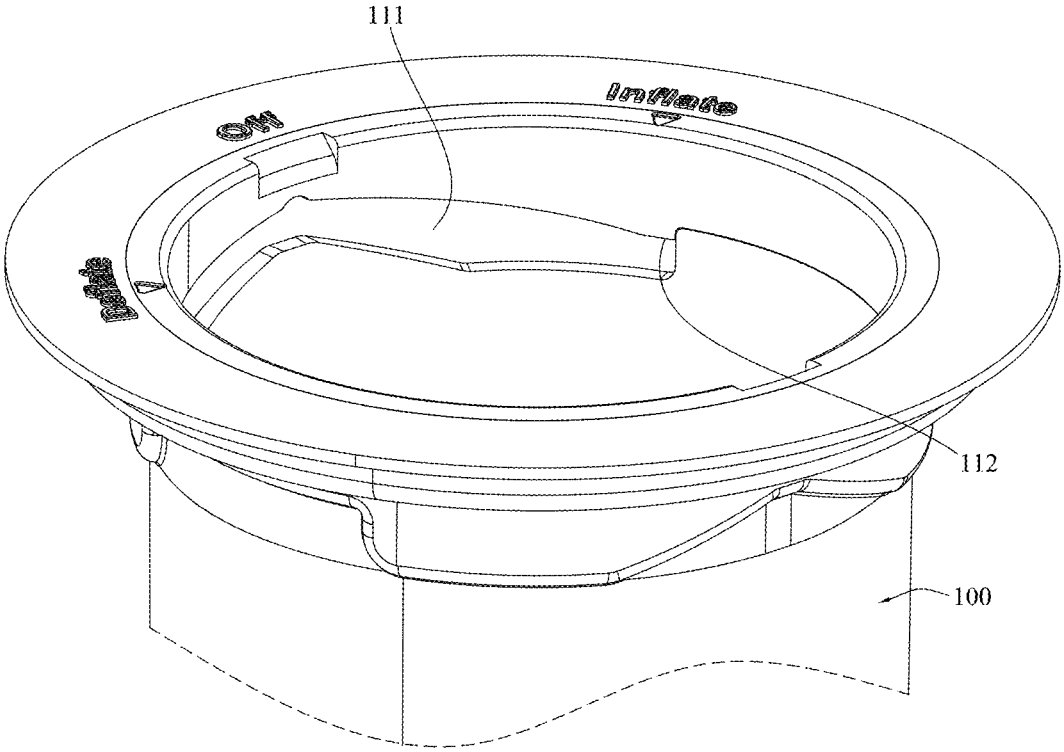
FIG. 11 is the other partial view of the housing shown in FIG. 2 from another angle.

As shown in FIGS. 1 and 11, in one embodiment, the middle portion of each of the sliding grooves 111 is distributed in an oblique direction towards two ends of the sliding groove 111 along a direction close to the housing hole 120.

It should be noted that the middle portion of the sliding groove 111 is inclined towards the two ends thereof and inclined along the direction close to the housing hole 120. In this way, when the clamping protrusion 231 is located in the middle of the sliding groove 111, the driving member 221 is in a stop state, and when the pump core 200 rotates in the chamber 110 in a clockwise direction, the clamping protrusion 231 slides along the sliding groove 111 from the middle to one end. In this way, because the structure from the middle of the sliding groove 111 to the two ends thereof is inclined close to the housing hole 120, the pump core 200 will slide at a certain distance in the axial direction relative to the chamber 110, and when the clamping protrusion 231 reaches one end of the sliding groove 111, the outlet hole 213 of the pump shell 210 abuts against the housing hole 120 so that the outlet hole 213 is in reliable communication with the housing hole 120. At this time, the driving member 221 is started to inflate the product. For the same reason, when the pump core 200 rotates counterclockwise in the chamber 110, the clamping protrusion 231 slides from the middle to the other end along the sliding groove 111. In this way, because the structure from the middle of the sliding groove 111 to the two ends thereof is inclined close to the housing hole 120, the pump core 200 also slides at a certain distance in an axial direction relative to the chamber 110, when the clamping protrusion 231 reaches the other end of the sliding groove 111, the air inlet 212 of the pump shell 210 abuts against the housing hole 120, thus, the inlet hole 212 is in reliable communication with the housing hole 120, and at this time, the driving member 221 is started to extract air from the product.

Figure 12:
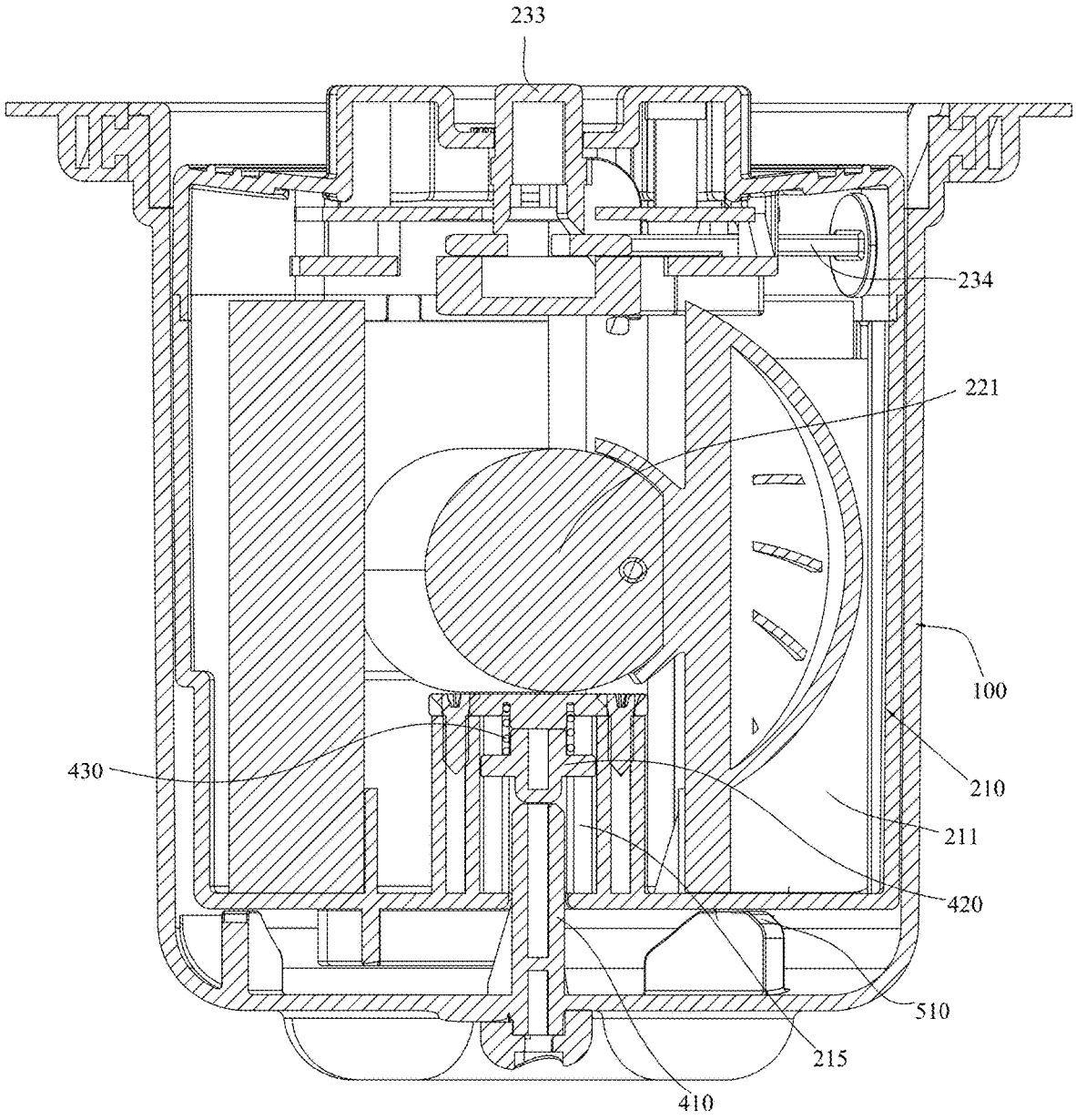
FIG. 12 is a sectional view of the rotary inflating and deflating pump shown in FIG. 6 in an inflating state.

As shown in FIGS. 2, 3 and 12, in one embodiment, a column 410 is provided on the inner bottom wall of the chamber 110, and a slot 215 is provided on one end of the pump shell 210 near the outlet hole 213. A sliding block 420 is provided in the slot 215, and a spring 530 is provided at the end of the sliding block 420 away from the column 410. The spring 430 is used to push the sliding block 420 to abut against the column 410.

It should be noted that when the clamping protrusion 231 is located in the sliding groove 111, the pump core 200 is completely accommodated in the chamber 110. For that the pump core 200 can be easily taken out, the column 410 is arranged on the inner bottom wall of the chamber 110, and located at the central position of the pump core 200. Correspondingly, the slot 215 is also located at the axial position of the pump shell 210, and the sliding block 420 pushed by the spring 430 is slidably mounted in the slot 215, one end of the column 410 extends into the slot 215 so that the sliding block 420 abuts against the column 410. In this way, when the clamping protrusion 231 retracts into the pump shell 210, the spring 430 pushes the sliding block 420 to slide in the slot 215, and the sliding block 420 abuts against the column 410 so that the pump core 200 exits from the chamber 110.

Figure 13:
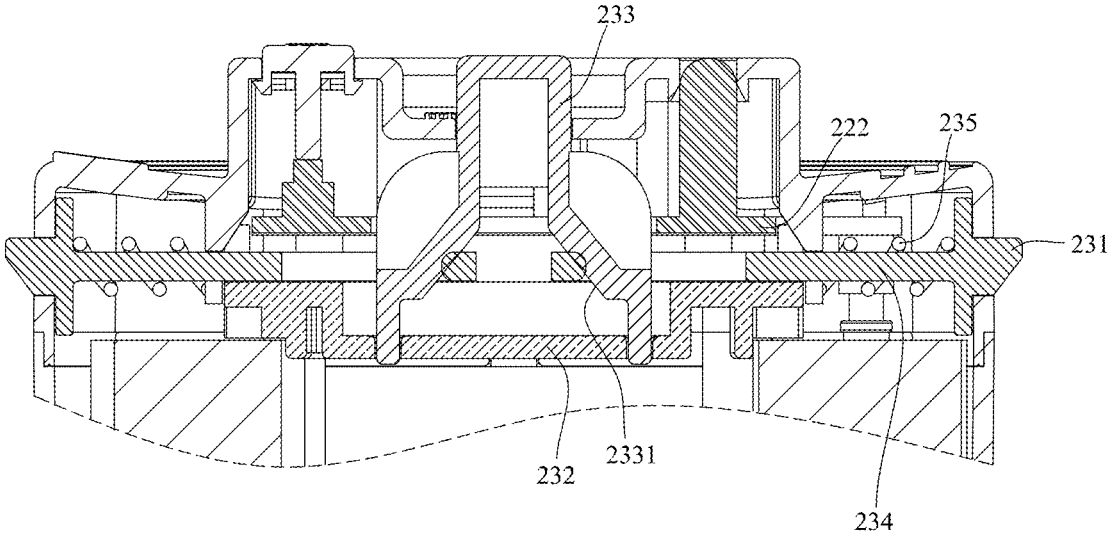
FIG. 13 is a partial sectional view from another angle of the pump core shown in FIG. 3.

As shown in FIGS. 1 and 13, in one embodiment, the pump core 200 further includes a supporting block 232, a pressing block 233, a side sliding block 234, and a side sliding spring 235. The supporting block 232 is arranged in the pump shell 210, the pressing block 233 is slidably along the axial direction of the pump shell 210 and arranged on the top of the pump shell 210, and the side sliding block 234 is slidably arranged on the supporting block 232, furthermore, the side sliding block 234 is connected to the pressing block 233, the side sliding spring 235 is sheathed on the side sliding block 234, and the side sliding spring 235 abuts against the side sliding block 234 and the supporting block 232 respectively. The clamping protrusion 231 is arranged on the side sliding block 234, and when the pressing block 233 is pressed, the pressing block 233 pushes the side sliding block 234 to slide so that the side sliding block 234 compresses the side sliding spring 235, and the clamping protrusion 231 retracts into the pump shell 210.

It should be noted that the supporting block 232 is mounted in the pump shell 210 by means of screws, the pressing block 233 is slidably mounted on the end away from the inlet hole 212 along the axial direction of the pump shell 210, and part of the pressing block 233 extends out of the top end of the pump shell 210. The side sliding block 234 is slidably mounted on the supporting block 232 along the radial direction of the pump shell 210, and the clamping protrusion 231 is located on the end of the side sliding block 234 away from the pressing block 233. The side sliding spring 235 is sleeved on the side sliding block 234, and the side sliding spring 235 abuts against the side sliding block 234 and the supporting block 232, respectively. In this way, under the action of the elasticity of the side sliding spring 235, the clamping protrusion 231 has a tendency to protrude out of the pump shell 210 in a natural state so that the clamping protrusion 231 snaps into the sliding groove 111. When a pressing force is applied to the pressing block 233, the pressing block 233 drives the side sliding block 234 to slide along the radial direction of the pump shell 210, the side sliding block 234 compresses the side sliding spring 235, and the clamping protrusion 231 retracts into the pump shell 210. In this way, the pump core 200 pops out from the chamber 110 under the pushing action of the spring 430. When the pressing force on the pressing block 233 is eliminated, the sliding spring 235 pushes the side sliding block 234 so that the clamping protrusion 231 again protrudes out of the pump shell 210.

Figure 14:
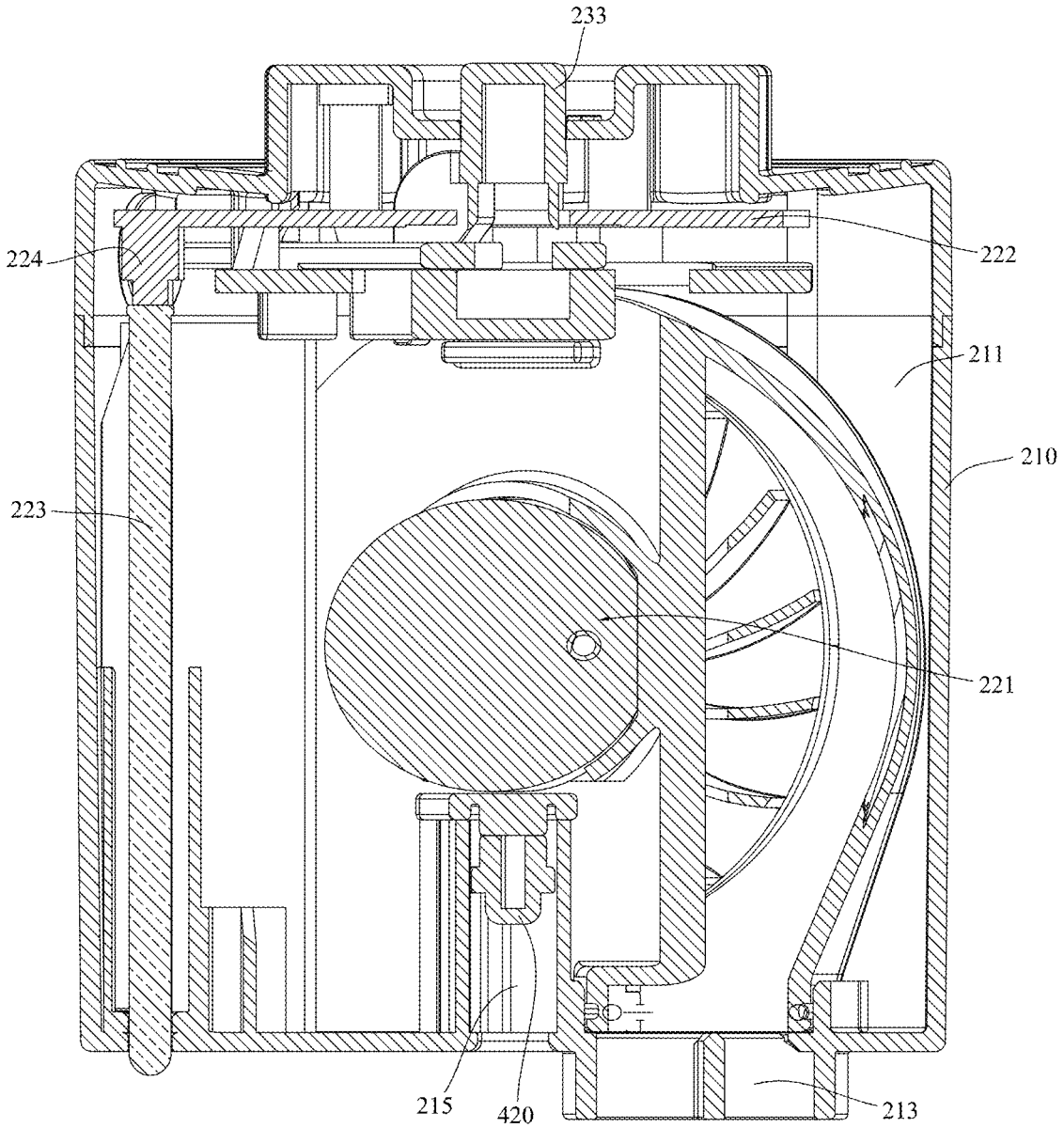
FIG. 14 is a sectional view of the sliding column according to an embodiment of the present disclosure.

As shown in FIGS. 2, 13 and 14, in one embodiment, the pump core 200 further includes a circuit board 222 and a sliding column 223. The circuit board 222 is arranged in the pump shell 210, electrically connected to the driving member 221, and provided with a switch 224. The sliding column 223 is slidably arranged in the pump shell 210 along the axial direction of the pump shell 210, with one end being in contact with the switch 224, and the other end extending out from one end of the pump shell 210 close to the outlet hole 213. Two top blocks 510 are provided on the inner bottom wall of the chamber 110, and when the pump core 200 is rotated clockwise or anticlockwise by the external force, one of the two top blocks 510 pushes against the sliding column 223.

It should be noted that the circuit board 222 is mounted on the inner side wall of the pump shell 210 by means of screws. The pump shell 210 is also provided with a guiding groove for the sliding column 223 to slide so that the sliding column 223 can be slid along the axial direction of the pump shell 210. The switch 224 is mounted on the circuit board 222, and one end of the sliding column 223 is in contact with the switch 224. In a natural state, only a contact state exists between the sliding column 223 and the switch 224, and no acting force exists therebetween. The other end of the sliding column 223 extends out from the end face of the pump shell 210 close to the outlet hole 213, and two top blocks 510 are provided on the inner bottom wall of the chamber 110. In this way, when the pump core 200 rotates clockwise or counterclockwise in the chamber 110, since the sliding groove 111 is in an inclined state, the clamping protrusion 231 slides along the sliding groove 111, and when the pump core 200 rotates, it slides at a certain distance relative to the axial direction of the pump shell 210, that is, as the pump core 200 rotates, the pump core 200 may bring the sliding column 223 to contact with one of the two top blocks 510. Thus, the sliding column 223 is pushed against by the top block 510, at this time, the sliding column 223 will press the switch 224, thereby starting the driving member 221. In this way, the driving member 221 can be started and stopped by rotating the pump core 200, and it is not necessary to additionally press to start, thereby being more convenient to use.

As shown in FIG. 13, in one embodiment, the pressing block 233 is provided with a first inclined surface 2331, and the side sliding block 234 is in contact with the first inclined surface 2331.

It should be noted that when the pressing block is applied the pressing force, the first inclined surface 2331 pushes the side sliding block 234 to slide along the axial direction of the pump shell 210, thereby the clamping protrusion 231 retracting into the pump shell 210. When the pressing force on the pressing block 233 is eliminated, the sliding spring 235 pushes the side sliding block 234 to move reversely so that the side sliding block 234 pushes the first inclined surface 2331, the clamping protrusion 231 again protrudes out of the pump shell 210, at the same time, the pressing block 233 extends out of the top of the pump shell 210.

In one embodiment, there are two clamping protrusions 231, two sliding grooves 111, two side sliding blocks 234, and two first inclined surfaces 2331. The two side sliding blocks 234 are respectively in contact with the two first inclined surfaces 2331, and the two clamping protrusions 231 are respectively provided on one end of the two side sliding blocks 234 away from the first inclined surface 2331. The two sliding grooves 111 are symmetrically distributed around the axis of the pump shell 210, and the two clamping protrusions 231 are located inside the two sliding grooves 111. In this way, it can ensure that the pump core 200 is stably inserted into the housing chamber 110.

As shown in FIG. 11, in one embodiment, both ends of the sliding groove 111 are equipped with a fastening plane 112.

It should be noted that both ends of the sliding groove 111 are equipped with a fastening plane 112, in this way, the pump core 200 rotates clockwise or counterclockwise to the ends of the sliding groove 111, the clamping protrusions 231 are located on the fastening planes 112. Since the fastening planes 112 are plane structure, the fastening planes 112 are parallel to the radial surface of the pump shell 210, the clamping protrusions 23 will remain stable on the fastening planes 112 and will not be pushed by the spring 430 to return from the end of the sliding groove 111 to the middle thereof. At this time, the pump can stably inflate or extract. When the pump completes the inflation or extraction of the product, it only needs a certain amount of torque be applied to the pump core 200 so that the clamping protrusions 231 are detached from the fastening planes 112. Under the elasticity of the spring 430, the clamping protrusions 231 slide back to the middle of the inclined groove 111 along the inclined sliding groove 111. At this time, the pump core 200 is reset, and the inlet hole 212 and outlet hole 213 are both far away from the housing hole 120. The sliding column 223 is also far away from the top block 510, causing the driving member 221 to stop In one embodiment, a seal ring is provided on the side of the housing hole 120 close to the chamber 110.

In this way, when the pump core 200 rotates to close to the housing hole 120, the inlet hole 212 or the outlet hole 213 tightly abuts against the seal ring so the inlet hole 212 or the outlet hole 213 is closely in communication with the housing hole 120.

The foregoing embodiments merely represent several implementations of the present disclosure, and are described in detail, but are not intended to limit the scope of the disclosure. Unless otherwise defined, the installation/fixation/setting mentioned in the present disclosure can be understood as including but not limited to lock fixation and welding using screws/screws. It should be noted that, for those skilled in the art, various modifications and improvements can be made without departing from the concept of the present disclosure, and all these modifications and improvements belong to the scope of protection of the present disclosure. Therefore, the scope of protection of the present disclosure should be subject to the appended claims.

The invention claimed is:

1. A rotary inflating and deflating pump, comprising:

a pump core, comprising a pump shell and a driving member; said pump shell is detachably installed into a housing chamber; a pump chamber is provided inside said pump shell, and an inlet hole and an outlet hole are provided on one end of said pump shell near a housing hole and respectively communicated with said pump chamber; said driving member is provided inside said pump chamber and used to drive air to enter the pump chamber from said inlet hole and then flow out from said outlet hole;

when said pump core rotates clockwise in said housing chamber under an external force, one of said inlet hole and said outlet hole is communicated to said housing hole; when said pump core rotates counterclockwise in said housing chamber under said external force, the other of said inlet hole and said outlet hole is communicated to said housing hole; when one of said inlet hole and said outlet hole is communicated to said housing hole, the other of said inlet hole and said outlet hole is communicated to said housing chamber;

wherein an outer wall of said pump shell is provided with clamping protrusions, an inner side wall of said housing chamber is provided with sliding grooves, and said clamping protrusions are accommodated in said sliding grooves in a sliding manner; and a middle portion of said sliding groove is distributed in an oblique direction towards two ends of said sliding groove along a direction close to said housing hole.

2. The rotary inflating and deflating pump according to claim 1, wherein an avoidance groove is provided on said inner bottom wall of said housing chamber and aligns with said outlet hole or said inlet hole.

3. The rotary inflating and deflating pump according to claim 1, wherein a non-return valve is slidably provided on a side of said housing hole away from said housing chamber along an axial direction of said housing hole, and said outlet hole or said inlet hole in communication with said housing hole is used for pushing said non-return valve away from said housing hole.

4. The rotary inflating and deflating pump according to claim 1, wherein an air duct is provided in said pump shell, extending from one end of said pump shell to the other end thereof, and independent of said housing chamber.

5. The rotary inflating and deflating pump according to claim 1, wherein a column is provided on said inner bottom wall of said housing chamber, and a slot is provided on one end of said pump shell near said outlet hole; a sliding block is provided in said slot, and a spring is provided at an end of said sliding block away from said column; said spring is used to push said sliding block to abut against said column.

6. The rotary inflating and deflating pump according to claim 5, wherein both ends of said sliding groove are equipped with a fastening plane.

7. The rotary inflating and deflating pump according to claim 5, wherein said pump core further includes a supporting block, a pressing block, a side sliding block, and a side sliding spring; said supporting block is arranged in said pump shell, said pressing block is slidably along said axial direction of said pump shell and arranged on a top of said pump shell, and said side sliding block is slidably arranged on said supporting block, said side sliding block is connected to said pressing block, said side sliding spring is sheathed on said side sliding block, and said side sliding spring abuts against said side sliding block and said supporting block respectively; said clamping protrusion is arranged on said side sliding block, and when said pressing block is pressed, said pressing block pushes said side sliding block to slide so that said side sliding block compresses said side sliding spring, and said clamping protrusion retracts into said pump shell.

8. The rotary inflating and deflating pump according to claim 6, wherein said pump core further includes a circuit board and a sliding column; said circuit board is arranged in said pump shell, electrically connected to said driving member, and provided with a switch; said sliding column is arranged in said pump shell along said axial direction of said pump shell, with one end being in contact with said switch, and the other end extending out from one end of said pump shell close to said outlet hole; two top blocks are provided on said inner bottom wall of said housing chamber, and when said pump core is rotated clockwise or anticlockwise by said external force, one of said two top blocks pushes against said sliding column.

* * * * *